US006081972A

United States Patent [19]

Strobel et al.

[11] Patent Number: 6,081,972

[45] Date of Patent: Jul. 4, 2000

[54] FIBER BAND FEED APPARATUS WITH GUIDE AND MONITOR FOR BREAKAGE

[75] Inventors: Michael Maria Strobel, Eichstätt; Friedrich Hauner, Ingolstadt; Helmut Mattis, Vohburg, all of Germany

[73] Assignee: Rieter Ingolstadt Spinnereimaschinenbau AG, Ingolstadt, Germany

[21] Appl. No.: 09/159,117

[22] Filed: Sep. 23, 1998

[30] Foreign Application Priority Data

Sep. 27, 1997 [DE] Germany ..... 197 42 784
Nov. 11, 1997 [DE] Germany ..... 197 49 831

[51] Int. Cl.[7] ..... D01H 5/32

[52] U.S. Cl. ..... 19/239; 19/157; 19/0.25

[58] Field of Search ..... 19/0.2, 0.21, 0.22, 19/0.23, 0.24, 0.25, 0.26, 157, 159 A, 159 R, 239; 226/11, 45; 242/157 R, 615.3

[56] References Cited

U.S. PATENT DOCUMENTS

| | | | |
|---|---|---|---|
| 3,043,991 | 7/1962 | Schneider et al. . | |
| 3,316,597 | 5/1967 | Nivens . | |
| 3,420,048 | 1/1969 | Ferri . | |
| 4,213,553 | 7/1980 | Leifeld | 226/196 |
| 4,229,628 | 10/1980 | Bogucki | 19/0.25 |
| 4,450,677 | 5/1984 | Von Ronai-Horvath et al. | 19/0.21 |
| 4,683,711 | 8/1987 | Glock | 19/0.21 |
| 4,914,785 | 4/1990 | Hauner et al. . | |
| 4,920,736 | 5/1990 | Stahlecker | 19/0.25 |
| 4,939,895 | 7/1990 | Raasch et al. . | |
| 4,982,477 | 1/1991 | Hosel . | |
| 5,487,208 | 1/1996 | Hauner | 19/0.25 |

FOREIGN PATENT DOCUMENTS

| | | |
|---|---|---|
| 4116299A1 | 11/1991 | Germany . |
| 4024474A1 | 2/1992 | Germany . |
| 4028365A1 | 3/1992 | Germany . |

*Primary Examiner*—Michael A. Neas
*Assistant Examiner*—Gary L. Welch
*Attorney, Agent, or Firm*—Dority & Manning

[57] ABSTRACT

The invention concerns a textile machine operating on fiber band with a feeding device for the fiber band and a guide element for the fiber band and further provided with a band monitor for the discovery of band breakage. The band monitor (BW, BW1, BW2, BW3) is placed always in the area of the guide element, in particular one band guide (BF) and another band guide element (FE, FE1, FE2, FE3) in the area of the band monitor (BW, BW1, BW2, BW3). The running time behavior of the fiber band (FB) is directly improved by the guide element (FE, FE1, FE2, FE3), that is, the vibrations of the fiber band (FB) are damped. This will avoid a situation wherein false alarm signals are given because of an originally vibrating fiber band at the band monitor.

15 Claims, 4 Drawing Sheets

FIBER BAND FEED APPARATUS WITH GUIDE AND MONITOR FOR BREAKAGE

BACKGROUND OF THE INVENTION

The invention concerns a textile machine with a fiber band feed apparatus and a guide element for guiding the fiber band and with a band monitor for detection of band breakage.

In the case of stretch (draw-frame) or flyer textile machines, a feed apparatus for fiber bands is known which is designed as a feed rack or feed table.

With the feed apparatus, that is with a feed rack or a feed table, as a rule, the fiber band is removed from an already positioned can and conducted to the textile machine.

The fiber band taken out of the can is removed upwardly in a vertical direction and then turned by a band guide in a generally horizontal direction. On the way to the stretch machine, the fiber band is taken through further band guides and guided horizontally. This corresponds to a feed rack.

In contrast to this, in the case of a feed table, the band directional turn is made by a driven means, that is, the band guide is designed as a pair of rolls, wherein the under roll is driven and the fiber is conveyed between the said pair of rolls. Additional sequential band guides correspond to those of the feed rack, that is, they are not driven.

Since, obviously, a band guide has the duty of guiding a fiber band, its meaning is completely encompassed in the concept "guide element".

Upon the installation of a feed apparatus, the valid principle is to recognize a band break in the area of the feed apparatus even before its entry into the textile machine, and to recognize this as soon as possible. The feed apparatus can also be applied, however, if the fiber band is to be received from a prior, fiber band generating, textile machine. Even in this case, there is to be in the feed apparatus a guide element with an installed band monitor.

As is shown by EP 302 322 A2, a known band guide guides a fiber band in a feed apparatus and, at the same time, detects a break in said band. A band break releases a signal through the band monitor, which signal is then employed to shut down the machine before the entry of the band end occurs. In this case, the band monitor is integrated into the band guide.

In the band guide, the single fiber band is run between two vertically disposed, outer entries to the band guide. The fiber band slides, in this operation, on a guide surface of the band guide. When sliding on this guide surface, the fiber band undergoes no change from the guided direction. The band guide is equipped with a band monitor for the detection of a band break. The band monitor is integrated into the guide surface of this band guide. This requires special manufacture and technologic integration of the band monitor in the band guide. No conventional band monitor is applicable, but a custom made unit is required. Since the sliding fiber band produces a permanent heating on the guide surface, the integrated electronics of the band guide must assure a high degree of temperature control. These related necessities in their totality, lead to the fact that this band guide with the integrated monitor is very expensive.

The placement of a guide element (band guide) and a conventional band monitor did not bring the desired result since the said monitor, during machine operation, registered band breaks where there were none. These erroneous signals interrupts the smooth running of production.

OBJECTS AND MAY OF THE INVENTION

Thus, a principal purpose of the invention is to make available a band monitor without integration into a guide element and at the same time, to avoid false signals from said band monitor. Additional objects and advantages of the invention will be set forth in part in the following description, or may be obvious from the description, or may be learned through practice of the invention.

One means of achieving this purpose is accomplished in accord with the characterized features of the invention wherein a textile machine is provided for processing fiber band with a feed apparatus for fiber band and a guide element for the guiding of a fiber band and with a band monitor for the detection of band breakage. The band monitor (BW, BW1, BW2, BW3) is always placed in the area of the guide element, in particular, one band guide (BF), and another guide element (FE, FE1, FE2, FE3) is located in the area of the band monitor (BW, BW1, BW2, BW3). In one embodiment of the invention, an additional, that is, another, guide element is installed directly following the said band monitor, positioning being relative to the transport direction of the fiber band.

In yet an alternate manner, the other guide element, again in reference to the transport direction of the fiber band, can be installed directly ahead of the band monitor.

The band monitor and/or the other guide element are adjustable as to position in reference to the transport direction of the fiber band. Advantageously, the band monitor and the other guide element are secured on a supporting element in common with the feed apparatus. Thus, the securing structure can be comprised of a support bracket, one leg of which carries the band monitor and parallel thereto a carrier bar is placed which bears the other guide element. This guide element can be designed as a rod or as an open band guide hook.

If the carrier at one end, along its longitudinal axis, is affixed to the support bracket, then the carrier can be turnable to a fixed position about its longitudinal axis. The carrier is adjustable, to the extent that the guide element can easily deflect the fiber band in relation to its transport direction. In this way, the fiber band is diverted in its transport direction from that direction imparted by the band guide.

The mode of installation can be so carried out that the other guide element is connected with the band monitor by a connection means. This connection piece can be pivotable and subject to being fixed in position, relative to an axis. The rod, which is designed as the other guide element, can be principally vertical in respect to the base of the feed apparatus, whereby this rod is adjustable in horizontal direction, at right angles to the fiber band.

Different installation locations of a guide element, especially of a band guide in a feed apparatus, do not limit the invention. The invention causes the running of the fiber band to be substantially smoother in the area of the band monitor. This in turn brings about the result that false signals caused by the fiber band are eliminated.

The band guide and the other guide element form a touching surface for the fiber band. The fiber band moving between the band guide and the other guide element possesses a relatively smooth run so that no false signal can be released by vibration of said fiber band.

One embodiment of the invention is presented in the drawings and is more closely described in the following.

DETAILED DESCRIPTION

Figure 1:
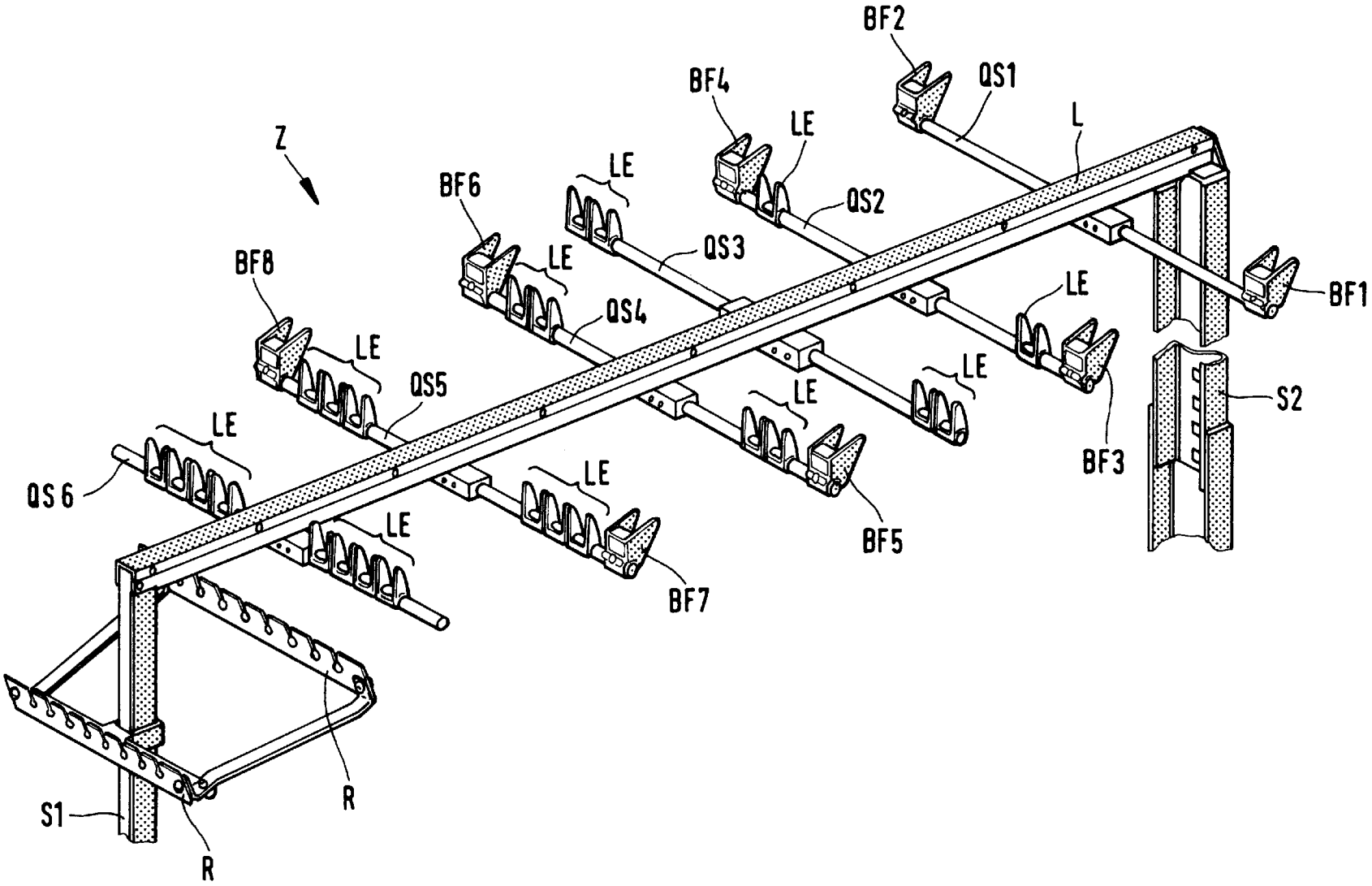
FIG. 1: the feed frame as a feed apparatus.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield still a third embodiment. It is intended that the present invention include such modifications and variations as come within the scope and spirit of the present invention.

FIG. 1 shows a known feed apparatus Z of a textile machine which processes fibers, which is designed as a feed rack. This feed apparatus Z is comprised principally of a longitudinal member L and two or more supports S1 and S2, which carry the longitudinal member L. The vertical supports S1 and S2 can advantageously be built in the manner of a telescope, by which an adjustment of the feed apparatus Z to accommodate cans of varying heights is possible.

The longitudinal member L carries several cross pieces QS1 to QS6. The cross pieces are affixed according to their centers, so that they extend to each side of the longitudinal member L. The number of the cross pieces is dependent upon the maximum number of cans which can be accommodated at the stretch machine.

The band guides BF1, BF2, BF3, BF4, BF5 which are respectively on an end of a cross piece QS1, QS2, QS3, QS4, QS5 are above a can (the can is not shown) and turn the fiber band arising vertically out of the can over into a horizontal direction (parallel to a non-shown base of the feed apparatus). The band guide is matched to a guide element. Beside the band guide are installed, generally, directional elements LE which serve for the horizontal guidance of a fiber band.

The exit of the feed apparatus Z is formed of a so-called rake R, so that the fiber bands, for instance, can be forwarded from there to the intake rolls of a stretch machine.

These intake rolls are designed as electrical contact rolls, that means that the lack of a fiber band releases an electrical output by the contact roll, so that a signal is given to a control system. Stopping the machine and/or instigating the feed of a backup reserve fiber band are possible reactions which can be generated by the said control system.

Figure 2:
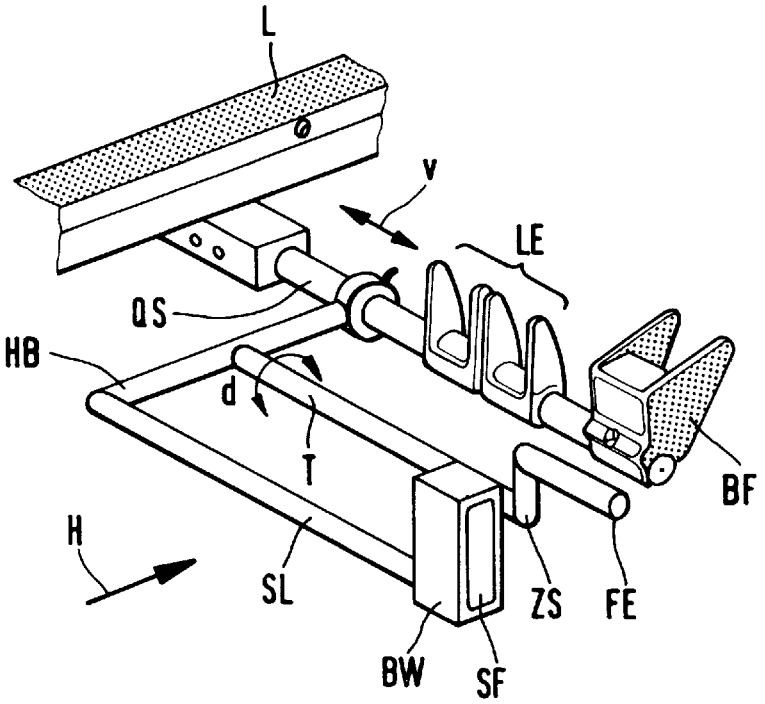
FIG. 2: feed element in the transport direction of the fiber band before the band monitor and the support system.

FIG. 2 shows a guide element, in particular a band guide BF affixed on a cross piece QS connected to a support structure H, which further carries a band monitor BW (with sensor surface SF) and another guide element FE. The support structure H can be extended as a support bracket HB. The support bracket HB has a leg SL. The band monitor BW is placed on this leg SL. The active sensor surface SF of the band monitor BW is so positioned, that it is set at right angles to the running direction of the fiber band. The support bracket HB also holds a carrier T at a spatial interval from the leg SL. At the end of the carrier T, an intermediate piece ZS is placed at an angle and bears on its end a guide element FE. The longitudinal axis of the guide element FE is arranged perpendicularly to the transport direction of the fiber band.

This positioning of the guide element FE achieves the damping of the vibrating fiber band. The support structure H is so disposed on the cross piece QS, that it is adjustable in the direction (v) on the longitudinal axis of the cross piece QS. Dependent upon the thickness of the fiber band and the characteristics of the material of the fiber band, this permits the band monitor BW to be brought into the exact supervisory position opposite to the fiber band.

This feature is especially important upon batch changes, that is, when the fiber band material or thicknesses are changed. An adjustment means is also provided for the guide element FE (see FIG. 3). The carrier T, which is part of this, can be installed angularly rotatable about its longitudinal axis (direction d) in the support bracket.

A rotation about the said longitudinal axis of the carrier T results in a pivoting of the guide element FE into the transport path TR of the fiber band FB or a retractive pivoting of the guide element FE out of the transport path TR of the fiber band FB. The arrow at the reference TR reflects the direction of transport of the fiber band. Depending upon different materials and thicknesses of various fiber bands, in the course of batch changes the guide element FE can be brought into position at the fiber band. The position in relation to the fiber band FB may be said to have been reached when the guide element FE lightly touches the said fiber band FE. By means of the touching of the guide element FE on the fiber band FB, the effect is created that the vibration, i.e. oscillation, of the fiber band FB is damped and the fiber band FB has a relatively smooth run immediately before the active sensor surface SF of the band monitor BW. The force of pressing of the guide element FE against the fiber band is adjustable by means of carrier T, depending upon the fiber band material currently in use. No delay of the fiber band is allowed to occur.

Figure 3:
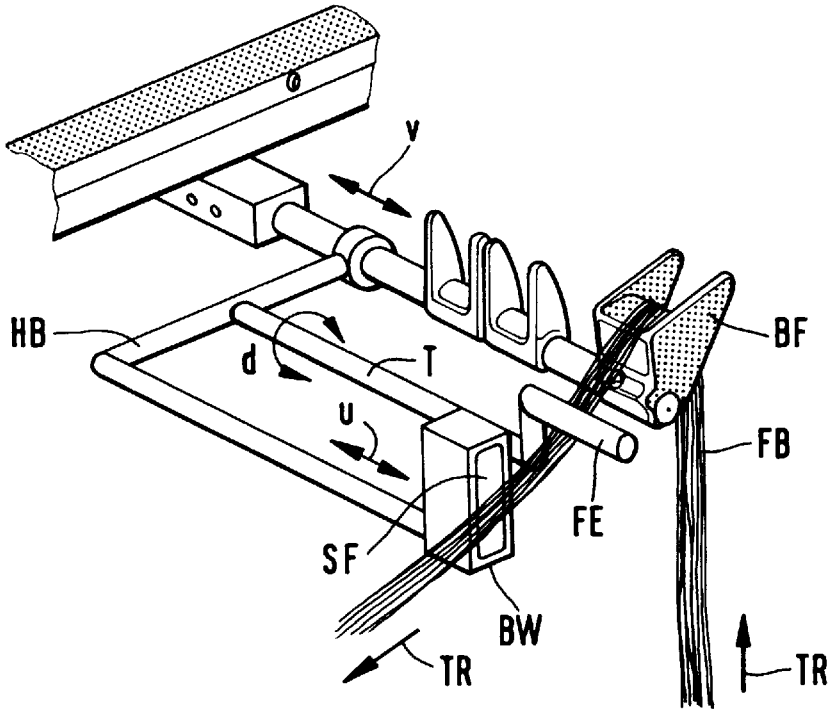
FIG. 3: adjustability of the support structure.

FIG. 3 shows an arrangement such as in FIG. 2, wherein the transport direction arrow TR of the fiber band is sketched in. If, based on spatial grounds, no adjustment of the support structure H in the direction v is practical, then alternately an adjustment of the band monitor BW in the direction u is possible (FIG. 3). At the same time, the offset of the band monitor BW in relation to the fiber band may be adjusted.

Figure 4:
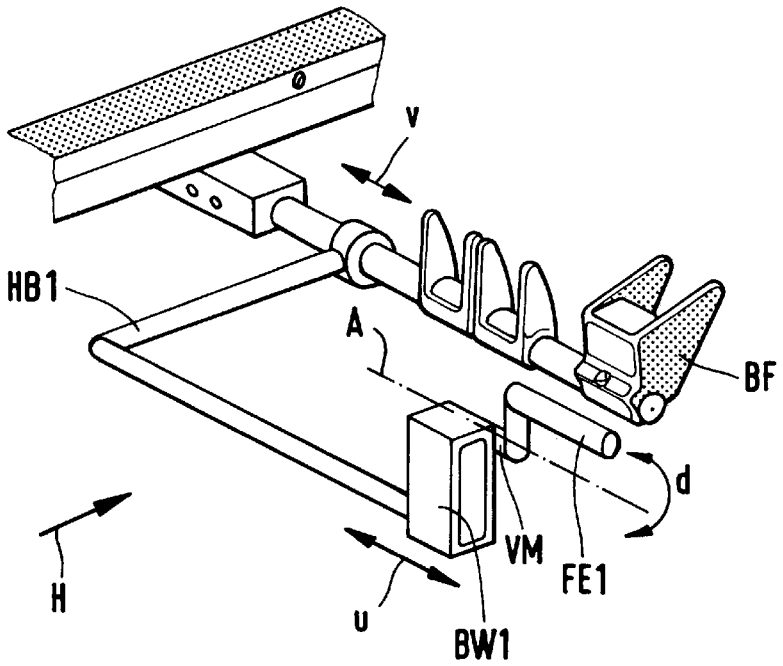
FIG. 4: guide element mounted on the band monitor.

FIG. 4 shows an arrangement of a band monitor BW1 with a guide element FE1, which, by means of the connection piece VM is attached to said band monitor BW1. The guide element FE1 is, in this case, pivotable about an axis A, as is the connection piece VM. Both may now be turned through a circular arc and arrested at a desired position. Band monitor BW1 and guide element FE1 are thus slidable in relation to the fiber band by the corresponding sliding of the support bracket HB1. This movement is possible in the directions v.

The guide element can be designed not only as a rod or a tube, but also as an open hook band guide.

Figure 5:
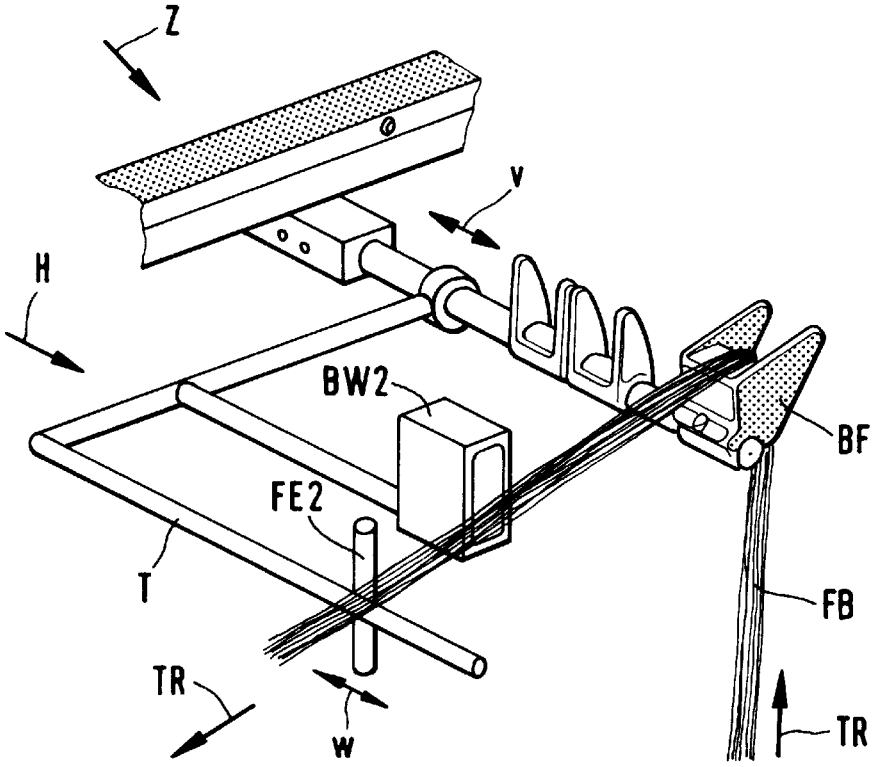
FIG. 5: guide element after the band monitor, relative to the transport direction.

Another embodiment variant is shown in FIG. 5. In this case, the band guidance is so setup, that in the transport direction (arrow of TR) of the fiber band FB, a band guide element FE2 is placed after the band monitor BW2. The guide element FE2 is vertical to the plane of the base of the feed apparatus Z. The function of the guide element FE2 is not diminished if it is turned out of the vertical position, although it possesses a tendency toward the vertical position. An advantage is that the guide element FE2 is designed as a rod. However, other configurations are conceivable, which make possible a contact surface with the fiber band. The rod is affixed to a supporting element of the feed apparatus Z.

The rod can be placed in a horizontal position (arrow w) at right angles to the transport direction of the fiber band FB. In this way, a change of direction of the fiber band FB in relation to the original transport path can be carried out. A common adjustment for band monitor BW2 and guide element FE2 can be achieved through the adjustment of the support element in the direction v.

By means of this band guidance, the fiber band has not only a contact surface on the band guide BF but also attains a contact surface with light pressure on the guide element FE2. Between the band guide BF and the guide element FE2, the fiber band runs in an advantageous manner without marked vibration. The achieved damping of the originally strongly vibrating fiber band makes possible a supervision of the fiber band without a false signal emanating from the band monitor BW2.

Figure 6:
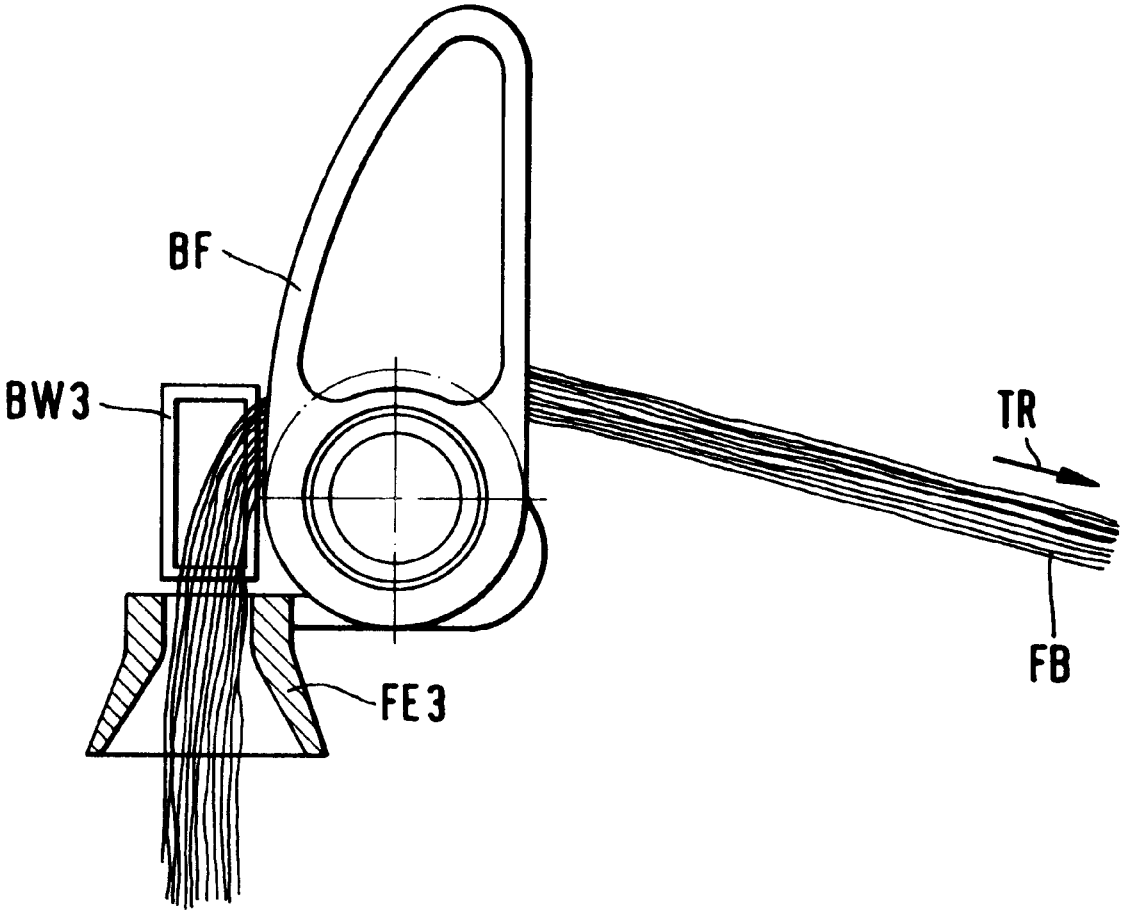
FIG. 6: guide element in front of the band monitor, relative to the transport direction.

Another embodiment is shown in FIG. 6. In this case the band monitor BW3 is placed in the area of the band guide BF. Relative to the transport direction of the fiber band FB, the band monitor BW3 is disposed in front of the band guide BF. The other guide element FE3 is in the area of band monitor BW3 and again relative to the direction of transport of the fiber band FB said guide element FE3 is before the band monitor BW3. The guide element FE3 is constructed as a ring. Band monitor BW3 and/or another guide element FE3 are adjustable as to position relative to the transport direction arrow of the fiber band FB. This design brings about the effect, that the fiber band is substantially damped in its vibration, so that faulty signals from the band monitor BW3 are avoided. A false signal arises, if, by means of excessive vibration, the fiber band is moved out of the range of the sensor surface SF. In this case, the band monitor can identify no fibers.

It will be apparent to those skilled in the art that various modifications and variations can be made in the present invention. It is intended that the present invention include such modifications and variations as come within the scope of the appended claims and their equivalents.

What is claimed is:

1. A textile machine for processing fiber band, comprising a feed apparatus to move fiber band for processing by said textile machine, said feed apparatus further comprising at least one first guide element and at least one second guide element spaced apart from said first guide element in a direction of travel of said fiber band so as to dampen out vibrations in said fiber band leaving said first guide element, and a band monitor device disposed adjacent said second guide element to detect the fiber band in its vibration dampened condition, said second guide element and said band monitor mounted on said feed apparatus along the running path of said fiber band and variably positionable relative to said first guide member and a transport direction of the fiber band so as to accomodate different types of fiber bands processed by said textile machine.

2. The textile machine as in claim 1, wherein said band monitor device is disposed between said first and second guide elements.

3. The textile machine as in claim 1, wherein said second guide element is disposed between said band monitor and said first guide element.

4. The textile machine as in claim 1, wherein said second guide element and said band monitor device are adjustable along the direction of travel of the fiber band.

5. The textile machine as in claim 1, wherein said band monitor device and said second guide element are disposed on a common frame member, said common frame member in turn mounted at a single location on said feed apparatus.

6. The textile machine as in claim 5, wherein said frame member comprises parallel extending spaced apart legs, said band monitor device mounted on one said leg and said second guide element disposed on another said leg.

7. The textile machine as in claim 6, wherein said another leg is adjustable relative to said frame member to vary the extent said second guide element deflects the fiber band.

8. The textile machine as in claim 7, wherein said another leg is rotatable about its longitudinal axis.

9. The textile machine as in claim 1, wherein said second guide element is connected to and spaced apart from said band monitor device.

10. The textile machine as in claim 9, wherein said second guide element is adjustable relative to said band monitor device.

11. The textile machine as in claim 1, wherein said second guide element comprises a rod that is disposed generally vertically against which the fiber band runs.

12. The textile machine as in claim 1, wherein said rod is adjustable in position in a direction generally perpendicular to the running direction of the fiber band.

13. A textile machine for processing fiber band, comprising a feed apparatus to move fiber band for processing by said textile machine, said feed apparatus further comprising at least one first guide element and at least one second guide element spaced apart from said first guide element in a direction of travel of said fiber band so as to dampen out vibrations in said fiber band leaving said first guide element, and a band monitor device disposed directly adjacent said second guide element to detect the fiber band in its vibration dampened condition, said band monitor device and said second guide element disposed on a common frame member, wherein said frame member comprises parallel extending spaced apart legs, said band monitor device mounted on one said leg and said second guide element dis posed on another said leg which is adjustable relative to said frame member to vary the extent said second guide element deflects the fiber band, and wherein said another leg is rotatable about its longitudinal axis.

14. A textile machine for processing fiber band, comprising a feed apparatus to move fiber band for processing by said textile machine, said feed apparatus further comprising at least one first guide element and at least one second guide element spaced apart from said first guide element in a direction of travel of said fiber band so as to dampen out vibrations in said fiber band leaving said first guide element, and a band monitor device disposed directly adjacent said second guide element to detect the fiber band in its vibration dampened condition, and wherein said second guide element comprises a rod that is disposed generally vertically against which the fiber band runs.

15. A textile machine for processing fiber band, comprising a feed apparatus to move fiber band for processing by said textile machine, said feed apparatus further comprising at least one first guide element and at least one second guide element spaced apart from said first guide element in a direction of travel of said fiber band so as to dampen out vibrations in said fiber band leaving said first guide element, and a band monitor device disposed directly adjacent said second guide element to detect the fiber band in its vibration dampened condition, and wherein said second guide element comprises a rod that is disposed generally vertically against which the fiber band runs, and wherein said rod is adjustable in position in a direction generally perpendicular to the running direction of the fiber band.

* * * * *